US005752657A

United States Patent [19]

Hogan et al.

[11] Patent Number: 5,752,657

[45] Date of Patent: May 19, 1998

[54] ROTATING FLUID WIDE BAND APPLICATOR

[75] Inventors: Michael B. Hogan, Weatogue; John P. Breault, New Britain; Dennis T. Callanan, West Hartford; Albert H. Weingart; Martin C. Cosgrove, both of Harwinton, all of Conn.

[73] Assignee: Loctite Corporation, Hartford, Conn.

[21] Appl. No.: 626,643

[22] Filed: Mar. 29, 1996

[51] Int. Cl.[6] ..... B05B 17/04

[52] U.S. Cl. ..... 239/7; 239/223; 239/567

[58] Field of Search ..... 239/223, 224, 239/548, 567, 7; 427/136, 238, 239

[56] References Cited

U.S. PATENT DOCUMENTS

| | | | |
|---|---|---|---|
| 2,220,275 | 11/1940 | Preston | 299/63 |
| 2,654,343 | 10/1953 | Burbank et al. | 118/317 |
| 2,894,485 | 7/1959 | Sedlacsik, Jr. | 118/626 |
| 2,975,755 | 3/1961 | Reindl | 118/626 |
| 2,986,338 | 5/1961 | Foster | 239/224 X |
| 2,994,482 | 8/1961 | Valois et al. | 239/567 X |
| 3,061,200 | 10/1962 | Ficker | 239/222 |
| 3,121,024 | 2/1964 | Wampler et al. | 118/2 |
| 3,343,981 | 9/1967 | Lenkei | 239/224 X |
| 3,387,992 | 6/1968 | Arthur et al. | 239/224 X |
| 3,552,652 | 1/1971 | Greenwood | 239/224 X |
| 4,407,217 | 10/1983 | Jackson | 118/24 |
| 4,828,178 | 5/1989 | Tucker et al. | 239/223 |
| 4,898,331 | 2/1990 | Hansen et al. | 239/223 |
| 5,226,605 | 7/1993 | Bazergui et al. | 239/223 X |

FOREIGN PATENT DOCUMENTS

| | | |
|---|---|---|
| 224956 | 8/1991 | Japan . |

*Primary Examiner*—Andres Kashnikow
*Assistant Examiner*—Steven J. Ganey
*Attorney, Agent, or Firm*—Hoffmann & Baron, LLP

[57] ABSTRACT

A rotating fluid wide band applicator head which permits application of a relatively wide band of fluid without the necessity for translational motion of the head with respect to the object being coated. The applicator head includes a rotatable body having an axis of rotation and having a fluid delivery chamber disposed within the body. A plurality of bounded channels having open inner ends and open outer ends are provided. The open inner ends of the channels are in fluid communication with the fluid delivery chamber, to receive fluid therefrom and transport the fluid. The open outer ends of the channels are arranged to discharge the fluid in a desired pattern, resulting in deposition of a band of fluid having a desired width.

20 Claims, 7 Drawing Sheets

ROTATING FLUID WIDE BAND APPLICATOR

BACKGROUND OF THE INVENTION

The present invention relates generally to coating devices, and, more particularly, to a rotating fluid wide band applicator suitable for coating the interior of a cylindrical bore with a band of fluid.

Various machines are known for applying coatings, such as sealants or adhesives, to interior cavities. In one type of coating device, a spinner cone or disk is rotated by an air motor. The fluid to be applied to the cavity (typically a cylindrical bore) is supplied to the rotating cone or disk from which it is dispensed via centrifugal force. Using this type of device, it is possible to apply a narrow band or single line of adhesive, with a maximum width of about ⅛ inch. In addition to low viscosity materials, fluids with dynamic viscosities up to 50,000 centipoise or higher can be handled.

In many industrial applications, it is desirable to apply a band of sealant or adhesive having a width greater than ⅛ inch. In order to achieve such widths, prior art devices require translational motion between the spinner cone or disk and the object being coated. For example, when a cylindrical bore is being coated, the cone or disk is positioned inside the bore, with its axis of rotation coincident with the longitudinal axis of the bore. In order to achieve the desired wide coating band, the cone or disk must be displaced along the axis of the bore in order to achieve full coverage. This displacement can be accomplished by traversing during a single application of fluid, or by making several discreet applications in different axial locations.

Alternative approaches to applying coatings to cavities have included touch applicator systems, where physical contact between the applicator and surface to be coated is to be required. In general, touch applicator systems are less desirable than those using centrifugal force, since the latter are cleaner, faster, and less wasteful of product.

Prior art centrifugal devices are less than ideal for application of wide bands of fluid since, as noted, relative translational motion is required between the applicator and surface to be coated. While cleanliness and economy in the use of product are still possible, speed suffers and cost and complexity increase when relative motion is required. There is, therefore, a need in the prior art for a rotating fluid wide band applicator which can dispense a wide band of fluid without relative translational motion between itself and the workpiece, thereby affording speed, economy, and cleanliness.

SUMMARY OF THE INVENTION

The present invention, which addresses the needs of the prior art, provides a rotating fluid wide band applicator head. The applicator head includes a rotatable body having an axis of rotation, as well as a fluid delivery chamber disposed within the rotatable body. A plurality of bounded channels are defined in the body and emanate from the fluid delivery chamber. Each of the channels has an open inner end in fluid communication with the delivery chamber, in order to receive fluid from the chamber and deliver the fluid.

The channels also have open outer ends for discharge of the fluid. In a preferred embodiment, each of the channels defines a corresponding flow path for the fluid, and each flow path has an outer endpoint coincident with the open outer end of the corresponding channel. Each flow path also has an inner endpoint coincident with the open inner end of the corresponding channel. The inner endpoints are circumferentially spaced from each other and lie in a common plane perpendicular to the axis of rotation. At least one of the channels is configured such that a straight line drawn between the inner and outer endpoints of its flow path forms a non-zero angle with the common plane of inner endpoints.

At least two of the channels are configured such that straight lines drawn between the inner and outer endpoints of their corresponding flow paths form different angles with the common plane of inner endpoints. The channels are sized, shaped and located for application of at least one band of fluid having a predetermined width. Most preferably, the channels are substantially straight and the flow paths are merely the longitudinal axes of the channels. The channels may be formed as bores in a solid machined body. Each channel is configured such that a straight line drawn between the inner endpoint and outer endpoint of its longitudinal axis intersects the common plane of inner endpoints at a preselected angle. Most preferably, these angles are selected so that their values increase successively, thereby defining a substantially helical pattern where the outer endpoints of the longitudinal axes intersect the outer surface of the solid machined body.

In an alternative embodiment of the present invention, the plurality of channels are also arranged so that the inner endpoints of their corresponding flow paths lie substantially in a common plane perpendicular to the axis of rotation of the body. The flow paths are configured so that fluid is discharged from their corresponding channels substantially parallel to the common plane of inner endpoints. The outer endpoints are axially spaced from each other, with respect to the axis of rotation, so that the fluid flowing through the channels will be applied in at least one band having a desired, predetermined width.

In a method of applying a band of fluid to a workpiece having an internal cavity, according to the present invention, a rotating fluid applicator head according to the present invention is provided. The rotating fluid applicator head is inserted into the internal cavity of the workpiece, fluid is supplied to the fluid delivery chamber of the rotating fluid applicator head, and the rotating fluid applicator head is rotated at a predetermined angular velocity with the fluid subjected to pressure sufficient to apply the fluid. In most applications, centrifugal force from the spinning of the head provides sufficient pressure. However, for some applications, such as high-viscosity fluids, it is envisioned that supplementary pressure will be applied.

As a result of the foregoing, the present invention provides a rotating fluid wide band applicator which can apply a wide band of fluid to a workpiece without relative translational motion between the applicator and workpiece during the coating process. The applicator is relatively easy to manufacture and economical to use. The applicator can be configured to be self-cleaning.

The invention further provides a rotating fluid wide band applicator head capable of uniform, continuous, uninterrupted and gap-free application of a band of fluid to an interior cylindrical cavity of a workpiece. This result can be achieved, for example, by having a plurality of channels which offer substantially the same resistance to flow of the fluid, thereby resulting in substantially uniform application of the fluid by each channel. A plurality of discrete bands is also possible. The present invention still further provides a rotating fluid wide band applicator head having a fluid delivery chamber with a ramp-like lower wall for smoothly directing fluid into the channels. Yet further, the present invention provides a method of using devices in accordance with the invention to coat internal cavities.

For a better understanding of the present invention, together with other and further objects and advantages, reference is made to the following description, taken in conjunction with the accompanying drawings, and its scope will be pointed out in the appended claims.

DETAILED DESCRIPTION OF THE INVENTION

Figure 1:
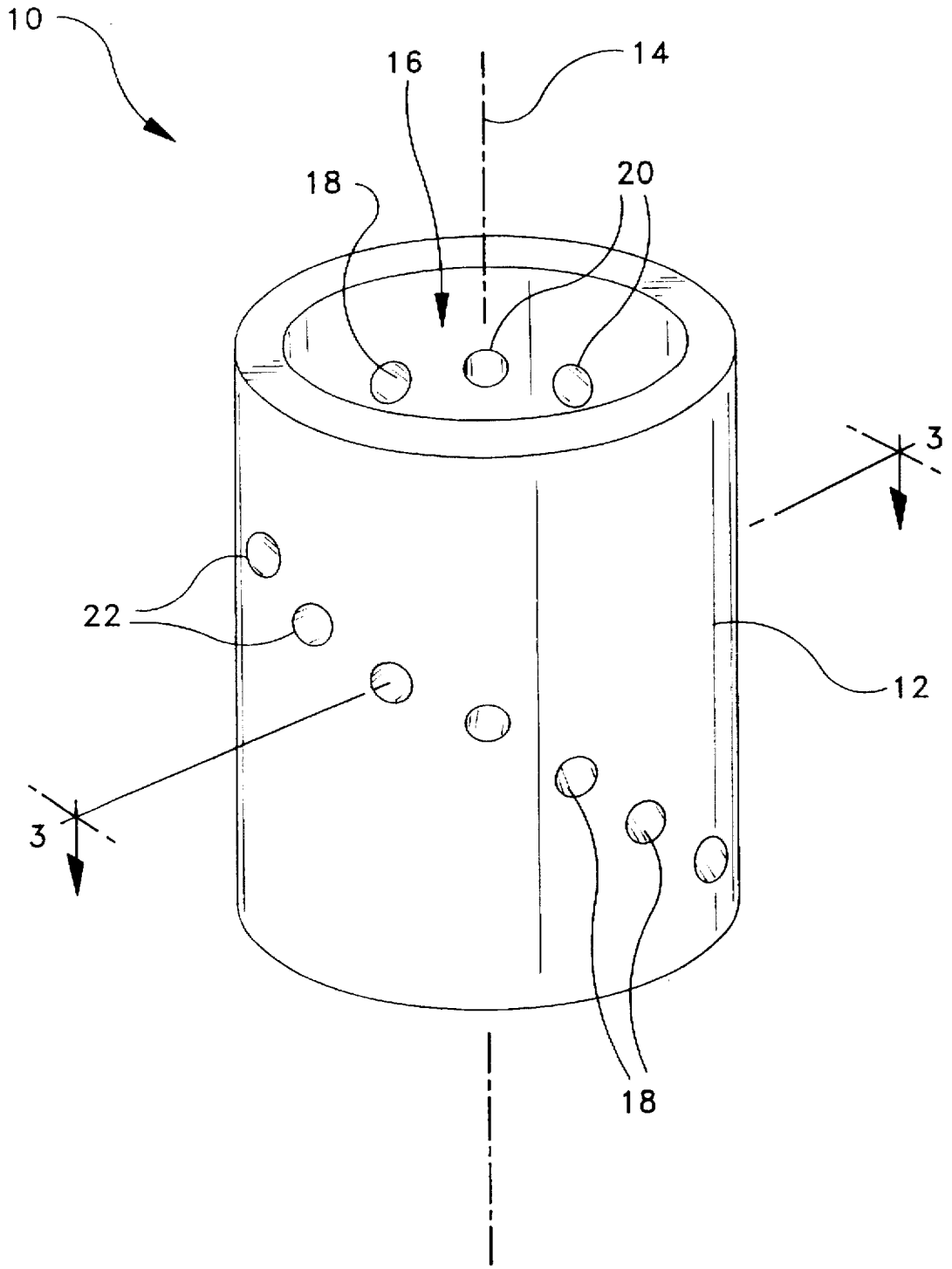
FIG. 1 is a perspective view of a rotating fluid wide band applicator head in accordance with a preferred embodiment of the present invention.

Referring to the drawings, FIGS. 1, 3, 4*a* and 4*b* show a rotating fluid wide band applicator head 10. The applicator head includes a rotatable body 12 having an axis of rotation 14. Rotatable body 12 may be formed from outer cylindrical sleeve 24 and inner bottom wall portion 26. Fluid delivery chamber 16 is disposed within body 12. A plurality of bounded channels 18 are defined within body 12 and emanate from chamber 16. As used herein with respect to channels, "bounded" means that the channels have an enclosed perimeter. Each of the channels 18 has an open inner end 20 in fluid communication with chamber 16, for purposes of receiving and delivering fluid from the chamber. Each of the channels also has an open outer end 22 for discharge of the fluid. Thus, each of the channels defines a corresponding flow path of the fluid, from the chamber 16, into channels 18 via open inner ends 20, and then out of open outer ends 22 of channels 18. As used herein, "flow path" refers to a line segment (which may be straight or curved) formed by connecting all the center points of adjacent cross-sections of the flow channel, which generally defines the path traveled by fluid flowing through that channel. For a straight channel of circular cross-section (as shown in FIGS. 1, 3, 4*a* and 4*b*) the flow path is simply the longitudinal axis of the channel.

Figure 2A:
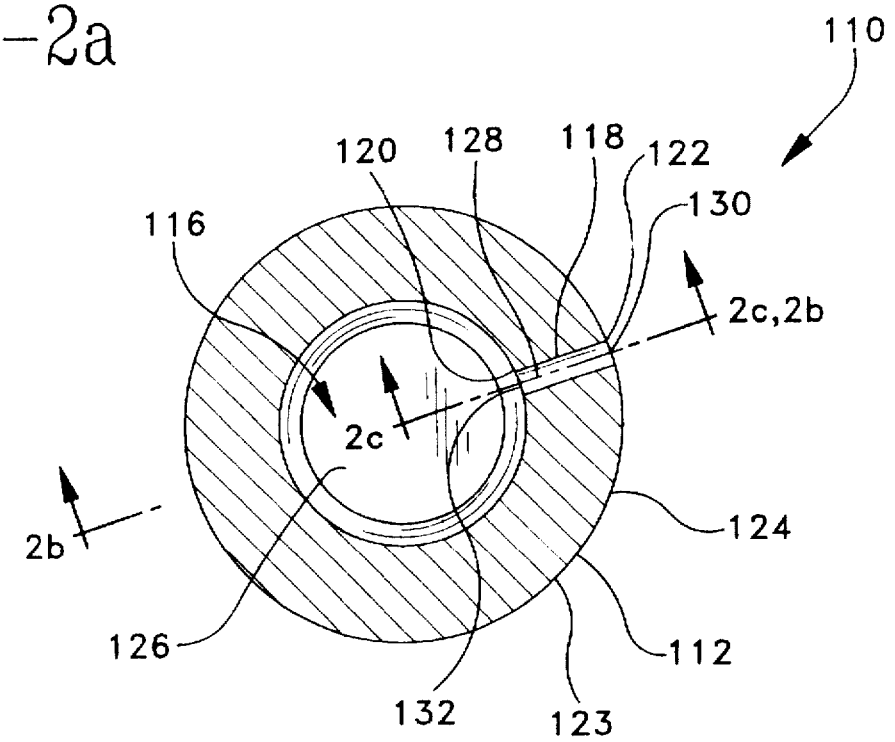
FIG. 2*a* is a transverse cross-section through an applicator head drawn in simplified form for purposes of defining geometric parameters.
Figure 2B:
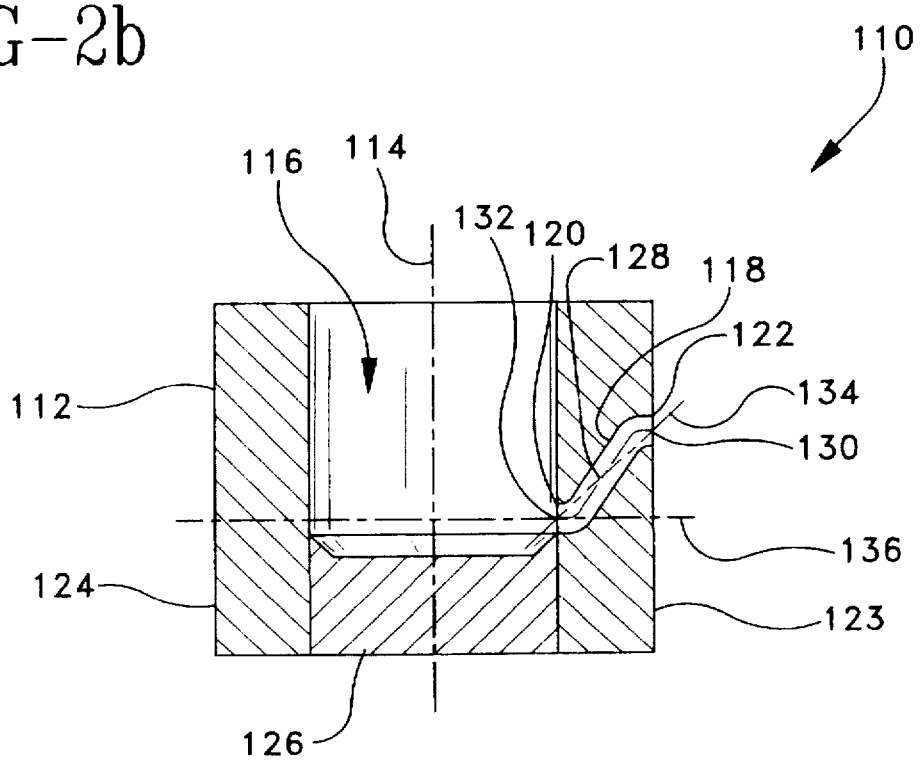
FIG. 2*b* is a longitudinal cross-section taken along line 2*b*—2*b* in FIG. 2*a;*
Figure 2C:
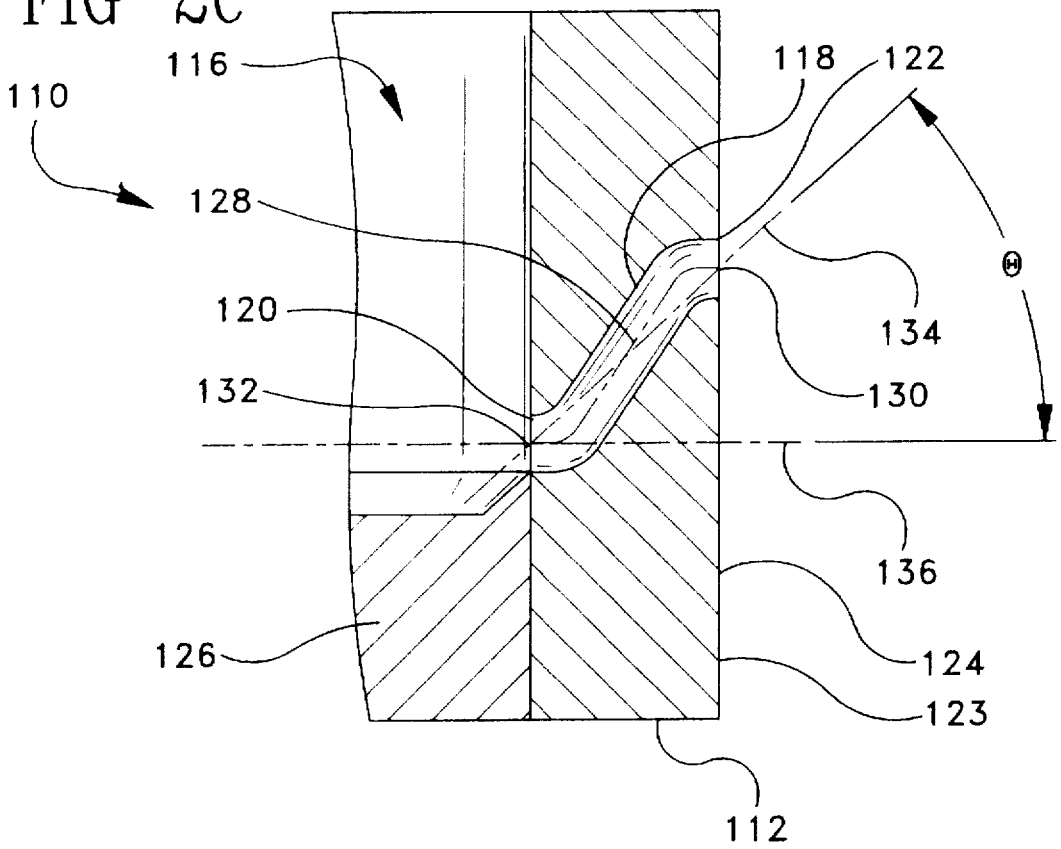
FIG. 2*c* is a partial longitudinal cross-section taken along line 2*c*—2*c* in FIG. 2*a;*

Referring now to FIGS. 2*a*–2*c*, which depict a fluid applicator head 110 drawn in simplified form for illustrative purposes, certain geometric considerations associated with the present invention will be discussed. Components similar to those depicted in FIGS. 1, 3, 4*a* and 4*b* have received the same reference number incremented by 100. Head 110 has been simplified in that only a single channel 118 with open inner end 120 and open outer end 122 is shown. Channel 118 defines a curved flow path 128.

Flow path 128 includes outer endpoint 130 coincident with open outer end 122 of channel 118. This flow path also includes inner endpoint 132 coincident with open inner end 120 of channel 118. Straight line 134 connecting inner endpoint 132 with outer endpoint 130 forms angle θ with plane 136, as best seen in FIG. 2*c*. Plane 136 is perpendicular to axis of rotation 114 and contains inner endpoint(s) 132. Referring again to FIGS. 1, 3, 4*a* and 4*b*, it can be seen that in the preferred embodiment depicted therein, the channels 18 are configured as straight cylindrical bores defining straight flow paths 28 coincident with their longitudinal axes. The longitudinal axes of all channels intersect axis of rotation 14. Although the straight channels with axes emanating from the axis of rotation are preferred for manufacturing purposes, it is to be understood that many configurations of channels 18 may be employed in practicing the present invention. In the first embodiment of the invention, at least one of the channels 18 defines a flow path 28 that is shaped such that a straight line drawn between the inner endpoint 32 and outer endpoint 30 of flow path 28 forms a non-zero angle with a common plane containing all inner endpoints 132 which is perpendicular to axis of rotation 14. Further, at least two of the channels 18 are configured such that straight lines drawn between the inner endpoints 32 and outer endpoints 30 of their flow paths 28 form different angles with the common plane of inner endpoints. The sizing, shaping, and location of the channels are selected so that they will discharge fluid onto an internal cavity, such as a cylindrical bore, to form at least one band having a predetermined width.

Figure 3:
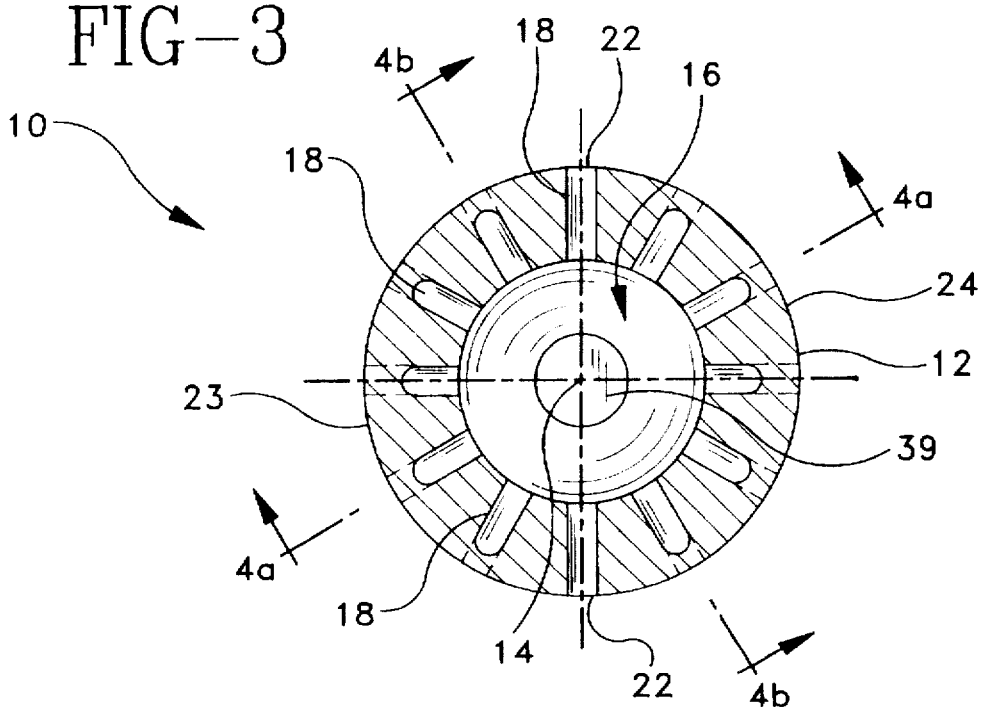
FIG. 3 is a transverse cross-section taken along line 3—3 of FIG. 1.
Figure 4A:
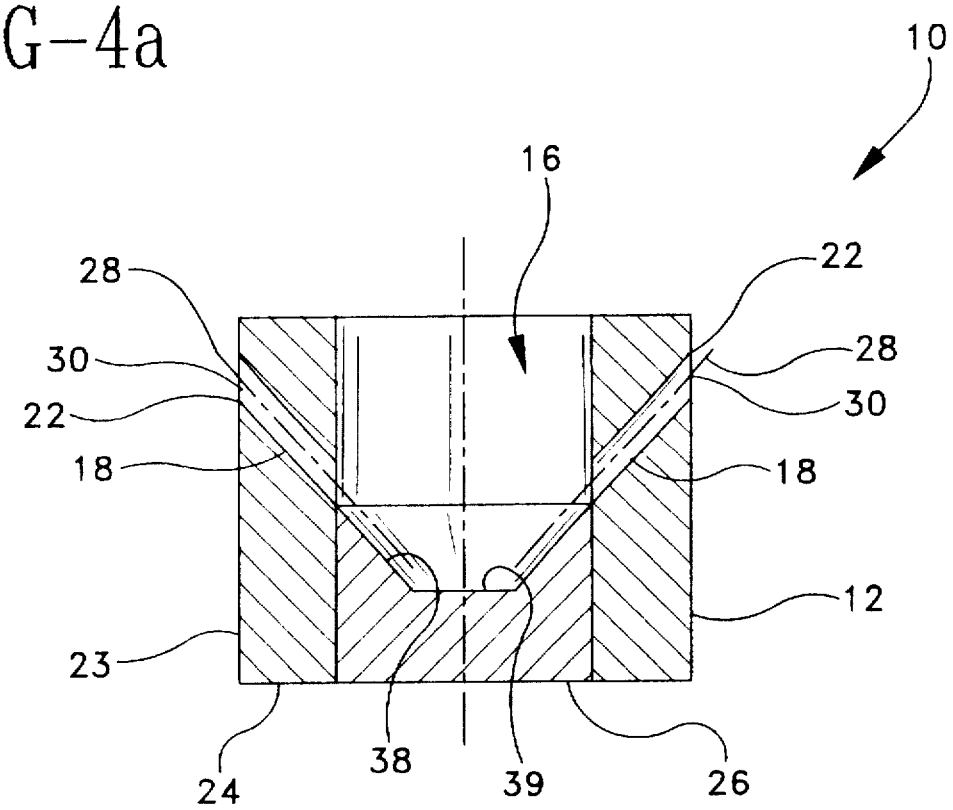
FIG. 4*a* is a longitudinal cross-section taken along line 4*a*—4*a* of FIG. 3.
Figure 4B:
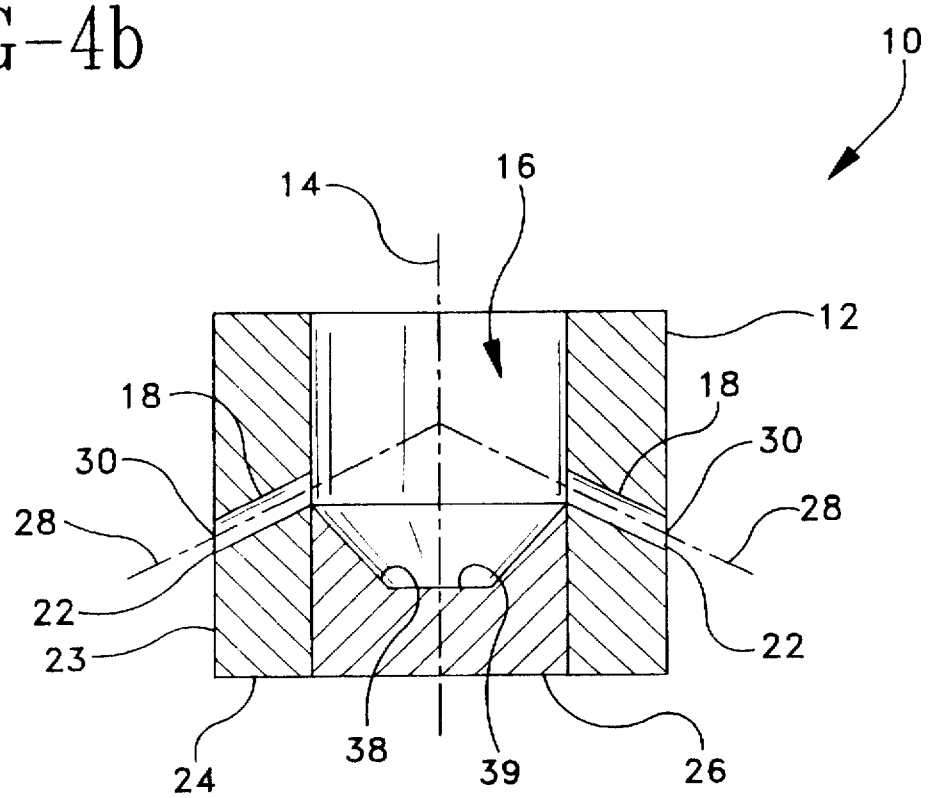
FIG. 4*b* is a longitudinal cross-section taken along line 4*b*—4*b* of FIG. 3.

Referring briefly to FIG. 3, note that those channels 18 which are angled upwards or downwards exhibit an elongated curved shape. This is the result of the intersection of the circular cross-section of the channels with the flat plane of the figure.

In order to achieve a continuous, uniform and substantially gap-free band of fluid, each channel 18 must be located so that it will deposit the fluid that it discharges in a desired portion of the band. The embodiment shown in FIGS. 1, 3, 4*a* and 4*b* achieves this by spacing the outer ends 22 of the channels both axially and circumferentially from each other. Most preferably, the circumferential spacing is uniform so that successive axes of adjacent channels 18 form uniform angles when viewed in transverse section. Regarding axial spacing, it is to be understood that fluid streams applied by adjacent channels should have minimal overlap and no intermediate gaps if a uniform band is desired. Further, it is to be understood that the channels may be configured to apply a plurality of discrete bands of fluid with gaps therebetween.

In theory, fluid emanating from angled channels will be spread over a greater area of the cylindrical surface to be coated than will fluid from channels which are not angled, producing localized coating thickness variations. In practice, this effect has been found to be minimal.

The inner endpoints 32 of flow paths 28 defined by channels 18 are also circumferentially spaced from each other, preferably uniformly. Inner endpoints 32, as noted, lie in a common plane perpendicular to the axis of rotation 14. Rotatable body 12 of applicator head 10 is preferably substantially unitary, meaning that it is made from one or two robust components such as cylindrical sleeve 24 and inner bottom wall portion 26. Fluid delivery chamber 16 preferably extends below the open inner ends 20 of the channel 18, and is formed with a ramp-like lower wall 38 for smoothly directing fluid into the channels 18 when body 12 is rotated.

In many applications, it will be desirable to meter a predetermined amount of fluid into fluid delivery chamber 16, in order to provide a band of predetermined thickness. Positioning inner endpoints 32 of flowpaths 28 defined by channels 18 such that they are coplanar, as described in the preceding paragraph, helps ensure that each channel will receive fluid simultaneously, contributing to uniform application of the fluid. A feed well region 39 of predetermined volume can be formed at the bottom of fluid delivery chamber 16 for receipt of a measured charge of fluid and for discharge of the fluid.

It will be appreciated that by proper sizing, shaping and location of channels 18, applicator head 10 can be designed to deposit a film of a desired width, and either of uniform thickness or with a heavier coating in some areas than others. For most of the applications envisioned, a uniform coat is most desirable. In order to achieve such a band of uniform thickness, it is desirable that each of the channels 18 afford substantially the same resistance to flow of the fluid. In this way, for a given inlet pressure, each will dispense the same volumetric flow rate of fluid. If each part of the band to be applied has its own channel or channels, and if all have substantially the same volumetric flow rate, it will be appreciated that a substantially uniform band will be applied.

Figure 5:
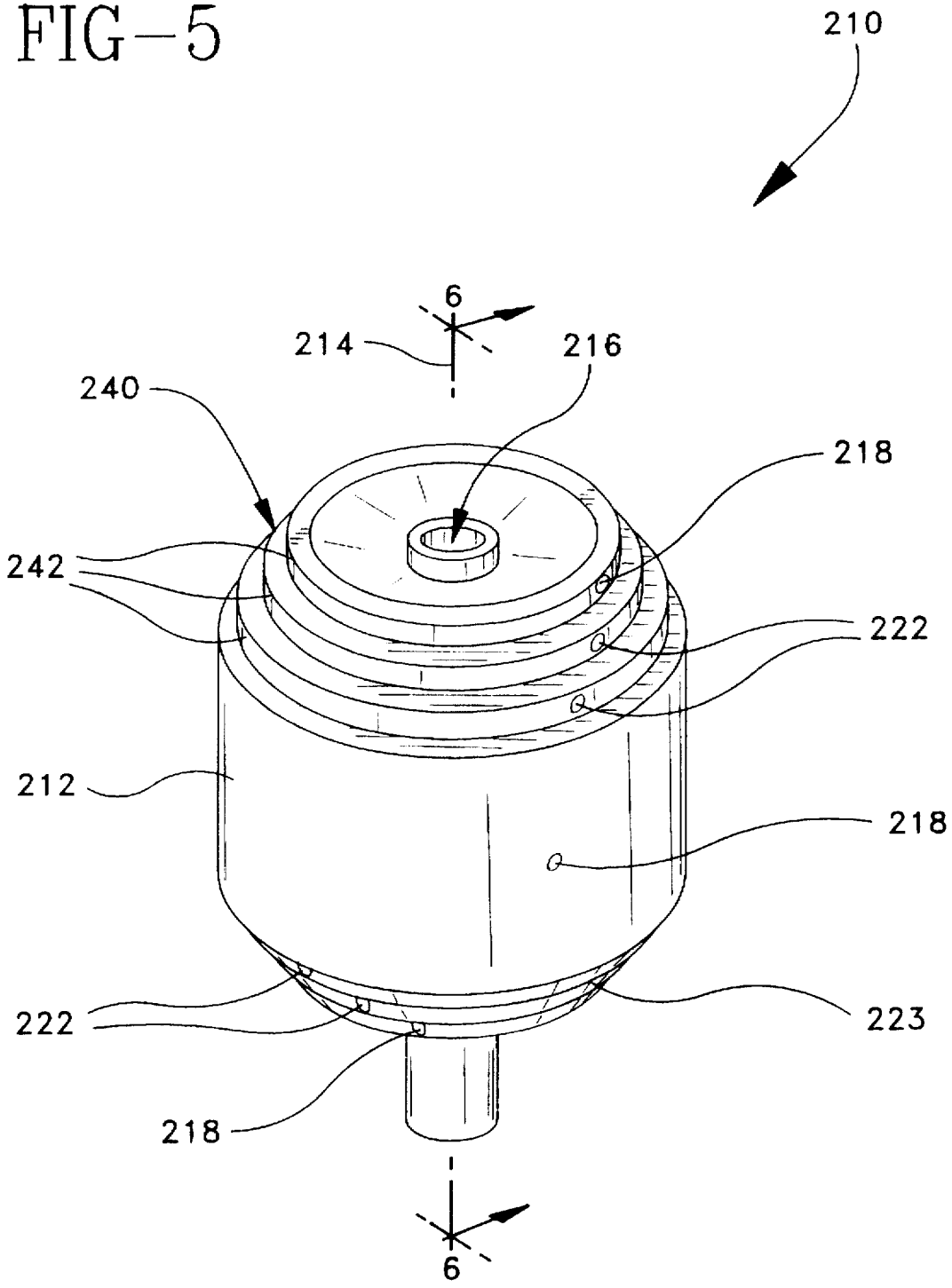
FIG. 5 is a perspective view of a rotating fluid wide band applicator head similar to that depicted in FIG. 1 but having further refinements.
Figure 6:
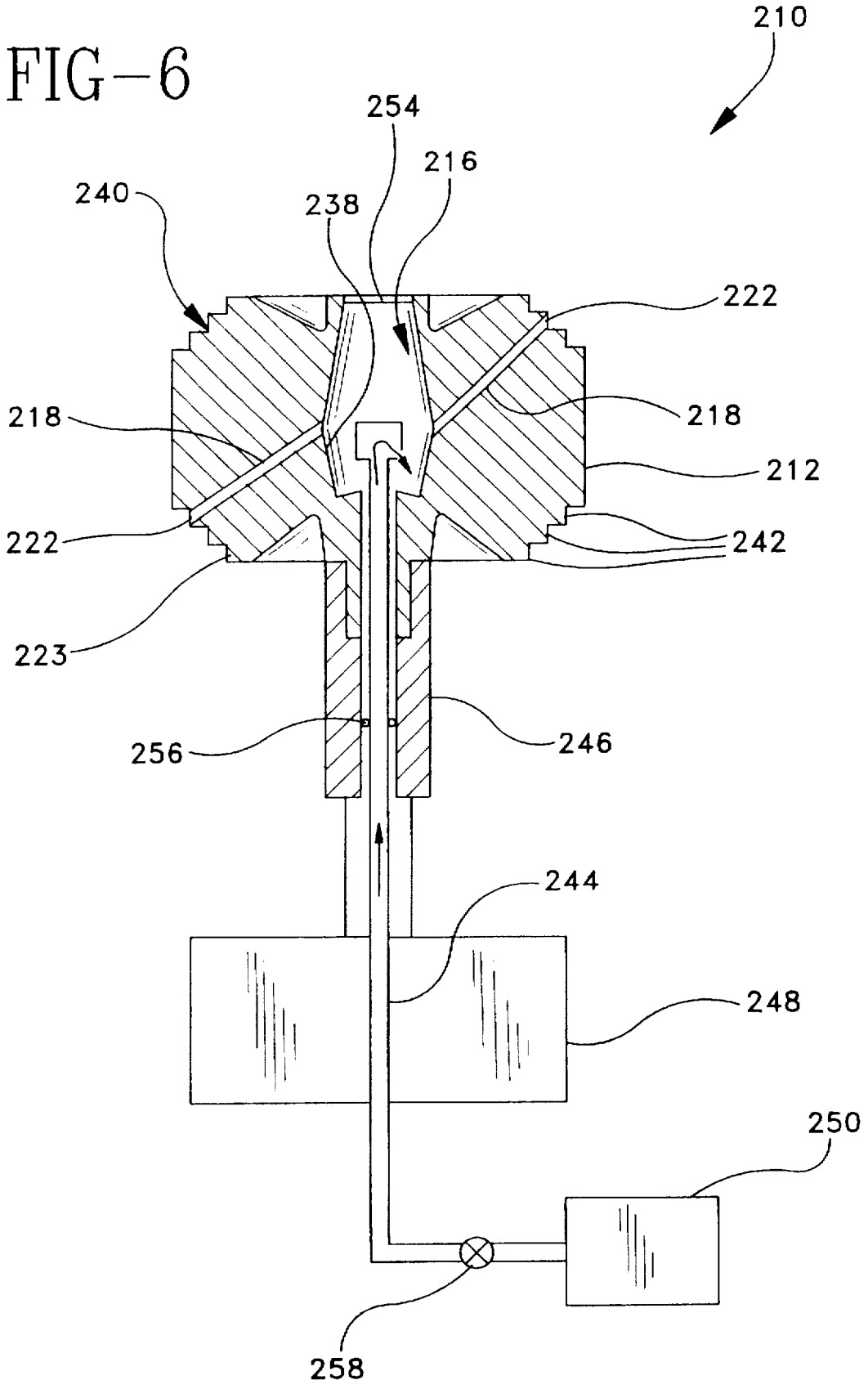
FIG. 6 is a longitudinal cross-section of the applicator head of FIG. 5 taken along line 6—6 of FIG. 5 and schematically depicting a rotary drive and fluid pressurization apparatus.

One way of insuring that all channels afford the same flow resistance is to form the channels with identical lengths and cross-sectional areas. Referring now to FIGS. 5 and 6, further refinements to the applicator head of FIGS. 1, 3, 4*a* and 4*b* will be shown. In FIGS. 5 and 6, like components have been given the same reference numbers as in FIGS. 1, 3, 4*a* and 4*b*, incremented by a factor of 200. Applicator head 210 is generally similar to head 10 but is formed with a tapered outer contour 240 which defines the length of channels 218 so that each channel 218 has the same length. With the channels all of similar diameter, they have substantially similar flow resistances. Thus, a substantially continuous, uninterrupted and gap-free band of fluid can be applied.

It will be appreciated that in either the embodiment of FIGS. 1, 3, 4*a* and 4*b* or of FIGS. 5 and 6, where the channels are straight and they define flow paths (longitudinal axes) which intersect the axis of rotation at various intersection angles, if the intersection angles are progressively increased, a substantially helical pattern will be formed on the outer surface 23 and 223 of the rotatable body by the open outer ends of the channels.

Returning again to FIGS. 5 and 6, tapered outer contour 240 is preferably formed with a plurality of steps 242 to promote self-cleaning. Since limited-pot-life adhesives and sealants are frequently used with the present invention, it is desirable to minimize or eliminate residual quantities of fluid which would harden or "gum-up" and clog the passages. It will be appreciated that polytetrafluorethylene, or another non-stick coating, can be applied to any of the embodiments of the invention disclosed herein. Further, after each use, the head 210 may be rotated without any fluid being supplied, in order to expel residual fluid.

With particular reference now to FIG. 6, applicator head 210 may be provided with a feed tube 244 and spinner tube 246, as shown schematically in that figure. Spinner tube 246 may be coupled to a rotary power device such as an air motor 248 in order to spin applicator head 210. Applicator head 210 must be rotated in order to apply a uniform band of fluid. The proper angular velocity will depend on the viscosity of the fluid and the type of product desired. In most cases, centrifugal force due to the rotation will be sufficient to induce the fluid to flow through the channels 218. A fluid supply pump 250 is preferably provided in order to feed fluid into chamber 216, although gravity feed may be employed in some cases. Valve 258 may be provided to control the flow. It will be appreciated that the collocation of fluid applicator head 210, feed tube 244, spinner tube 246 and air motor 248 provides a fluid applicator assembly.

In certain applications, such as the application of high-viscosity fluids, the pressure induced by centrifugal force may not be enough, in itself, to promote sufficient flow of fluid through the channels 218. In this case, fluid supply pump 250 may serve to provide supplemental pressure, and chamber 216 must be sealed, by, for example, fixed top closure 254 and rotary shaft pressure seal 256, as shown in FIG. 6. It will be appreciated that in lieu of or in conjunction with pump 250, an alternative supplemental flow-inducing device, such as a gas manifold providing an overpressure, may be employed.

Figure 7:
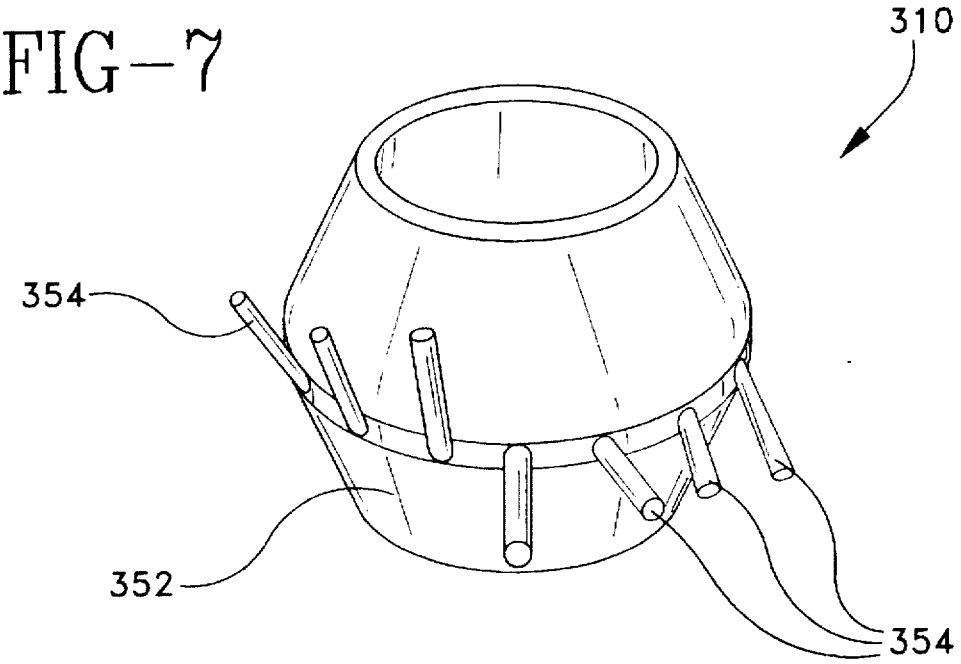
FIG. 7 is a perspective view of an alternative embodiment of fluid applicator head in accordance with the present invention.

FIG. 7 shows an alternative embodiment of a fluid applicator head 310 in accordance with the present invention. Its construction is essentially similar to that of the preferred embodiment discussed above, except that the rotatable body includes a main chamber part 352 with channels defined by a plurality of tubes 354 connected to chamber part 352. Identical tubes can be spaced, for example, 180 degrees apart (when head 310 is viewed in transverse cross section) to prevent unbalanced forces due to rotation. It will be appreciated that further embodiments, wherein the channels are defined in part within a rotatable body and in part by one or more tubes, are also within the scope of the present invention.

Figure 8:
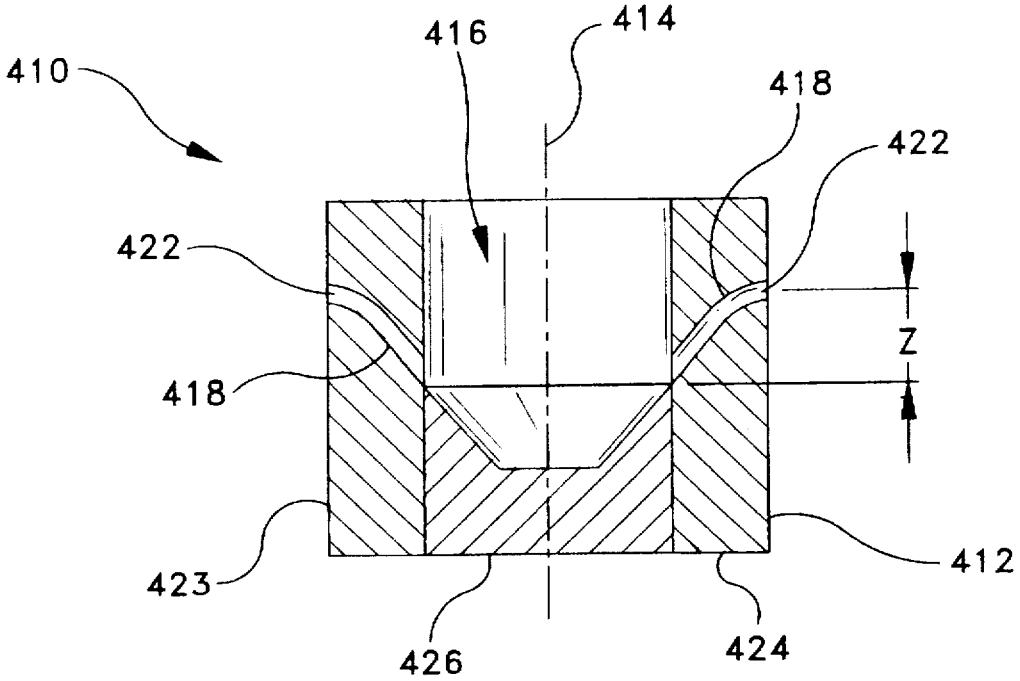
FIG. 8 is a longitudinal cross-section through yet another alternative embodiment of fluid applicator head in accordance with the present invention.

Referring finally to FIG. 8, another embodiment of the present invention is shown. Applicator head 410 is constructed similarly to the embodiment shown in FIGS. 1, 3, 4*a* and 4*b*, except for a different construction of channels 418. As in the other embodiments, channels 418 emanate from fluid delivery chamber 416 and have open inner ends 420 in fluid communication with fluid delivery chamber 416. The channels also have open outer ends 422 and define flow paths for the fluid. The flow paths have, as before, inner endpoints lying in a common plane perpendicular to axis of rotation 414. The inner endpoints are circumferentially spaced from each other. The flow paths are configured such that fluid is discharged from the corresponding channels 418 substantially parallel to the common plane of inner endpoints.

Each channel 418 (or pair of channels) can be formed such that the outer endpoint of its corresponding flow path lies at a different axial coordinate Z, so that a band of fluid of predetermined width can be formed (i.e., its width will be roughly equal to the distance between the highest and lowest Z coordinates plus one channel diameter). The plane of inner endpoints defines the zero value of Z. Note that FIG. 8 is a cross-section showing only one pair of channels 418 with the same Z coordinate; it is to be understood that a series of additional channels with different Z-coordinates are provided. It should also be recalled from the discussion above that each flow path is a line segment (which may be curved) connecting the center points of the adjacent cross-sections of its corresponding channel. Thus, the outer endpoints are simply the center points of the channels at their outer ends. It will be appreciated that the embodiments with straight channels are preferred for ease of manufacturing; however, other embodiments can be manufactured by, for example, lost wax casting.

In operation of any of the embodiments of the present invention described herein, fluid to be applied to a cavity is supplied to fluid delivery chamber 16. Body 12 is rotated about its axis of rotation 14 and fluid is urged into channels 18 (with supplemental pressurization if needed, as discussed above). Fluid is discharged from channels 18, either as continuous streams or as atomized droplets, depending on relative surface tension forces. The channels are shaped and positioned in one of the patterns described herein, to achieve desired coating. It is to be understood that if a non-uniform coating were desired, more channels could be pointed at a given area to receive more coverage, or channels pointed in that area could have a lower flow resistance than others, in order to receive more fluid.

In a method according to the present invention, a rotating fluid wide band applicator head in accordance with the present invention is provided. The applicator head is inserted into an internal cavity of a workpiece to be coated. Fluid is supplied to the fluid delivery chamber of the rotating fluid applicator head, and the rotating fluid applicator head is rotated at a predetermined angular velocity with the fluid subjected to pressure sufficient to apply the fluid. The pressure may be due solely to centrifugal force, or it may be supplemented, especially for high-viscosity applications.

While there have been described what are presently believed to be the preferred embodiments of the invention, those skilled in the art will realize that various changes and modifications may be made to the invention without departing from the spirit of the invention, and is intended to claim all such changes and modifications as fall within the scope of the invention.

What is claimed is:

1. A rotating fluid wide band applicator head comprising:

a rotatable body having an axis of rotation said rotatable body including a top portion and a bottom portion and a perimetrical wall portion therebetween defining a fluid delivery chamber disposed within said rotatable body; and a plurality of bounded channels defined in said body extending through said perimetrical wall and emanating from said fluid delivery chamber, each of said channels having substantially the same length and having an open inner end in fluid communication with said fluid delivery chamber for reception of fluid from said chamber and for delivery of said fluid, each of said channels having an open outer end for discharge of said fluid, the perimeters of said open inner end and said open outer end of each of said channels lying in respective planes substantially parallel to said axis of rotation each of said channels defining a corresponding flow path of said fluid, each of said flow paths having an inner endpoint coincident with the open inner end of the corresponding channel and an outer endpoint coincident with the open outer end of the corresponding channel, said inner endpoints lying in a common plane perpendicular to said axis of rotation of said body, said inner endpoints being circumferentially spaced from each other, at least one of said channels being configured such that a straight line drawn between the inner endpoint and outer endpoint of its flow path forms a non-zero angle with said common plane of inner endpoints, at least two of said channels being configured such that straight lines drawn between the inner endpoints and outer endpoints of their corresponding flow paths form different angles with said common plane of inner endpoints, said channels being sized, shaped and located for application of at least one band of said fluid having a predetermined width.

2. The rotating fluid applicator head of claim 1, wherein said outer ends of said channels are circumferentially spaced from each other.

3. The rotating fluid applicator head of claim 1, wherein said channels are sized, shaped and located for application of a plurality of discrete bands of said fluid.

4. The rotating fluid applicator head of claim 1, wherein said channels are sized and shaped to afford substantially similar resistance to flow of said fluid, said substantially similar resistance contributing to uniform application of said fluid.

5. The rotating fluid applicator head of claim 1, wherein said channels have substantially the same cross-sectional area.

6. The rotating fluid applicator head of claim 5, wherein said channels produce a substantially continuous, uninterrupted and gap-free-band of said fluid.

7. The rotating fluid applicator head of claim 1, wherein said rotatable body is substantially unitary and has a generally tapered-contour outside surface including a plurality of steps, and wherein said outer ends of said channels coincide with said plurality of steps of said outside surface.

8. The rotating fluid applicator head of claim 1, wherein said rotatable body is fitted with a plurality of tubes for defining said channels.

9. A rotating fluid wide band applicator assembly comprising:

a rotating fluid wide band applicator head including:

a rotatable body having an axis of rotation said rotatable body including a top portion and bottom portion and a perimetrical wall portion therebetween having an exterior surface;

a fluid delivery chamber disposed within said rotatable body and defined by said bottom portion and said perimetrical wall; and a plurality of substantially straight, bounded channels defined in said body extending through said perimetrical wall and emanating from said fluid delivery chamber, each of said channels having substantially the same length and having an open inner end in fluid communication with said fluid delivery chamber for reception of fluid from said chamber and for delivery of said fluid, each of said channels having an open outer end for discharge of said fluid, the perimeters of said open inner end and said open outer end of each of said channels lying in respective planes substantially parallel to said axis of rotation each of said channels having a corresponding longitudinal axis with an outer endpoint coincident with the open outer end of the corresponding channel, said outer endpoints of said longitudinal axes of said channels intersecting said exterior surface of said rotatable body at a plurality of pre-selected locations, each of said longitudinal axes of said channels having an inner endpoint coincident with the open inner end of the corresponding channel, said inner endpoints of said longitudinal axes of said channels being circumferentially spaced from each other and lying in a common plane perpendicular to said axis of rotation of said body, each of said channels being configured such that a straight line drawn between the inner endpoint and the outer endpoint of its longitudinal axis intersects said common plane of inner endpoints at a preselected one of a plurality of channel intersection angles, said intersection angles defining said pre-selected locations where said outer endpoints of said longitudinal axes of said channels intersect said exterior surface of said rotatable body, said intersection angles being pre-selected for application of at least one uniform band of said fluid having a predetermined width, at least one of said intersection angles being non-zero, at least two of said intersection angles being different from each other;

a spinner tube coupled to said rotating fluid wide band applicator head;

a rotary power device coupled to said spinner tube; and a feed tube disposed in fluid communication with said fluid delivery chamber of said rotating fluid wide band applicator head.

10. The rotating fluid wide band applicator assembly of claim 9, wherein said fluid delivery chamber of said rotating fluid wide band applicator head has a sealed top, further comprising a rotary shaft pressure seal for sealing between said rotating fluid wide band applicator head and said feed tube.

11. The rotating fluid wide band applicator assembly of claim 10, further comprising a supplemental flow inducing device disposed in fluid communication with said fluid delivery chamber of said rotating fluid wide band applicator head.

12. A rotating fluid wide band applicator head comprising:

a rotatable body having an axis of rotation, said rotatable body including a top portion and a bottom portion and a perimetrical wall portion therebetween having an exterior surface;

a fluid delivery chamber disposed within said rotatable body; and a plurality of substantially straight bounded channels defined in said body extending through said perimetrical wall and emanating from said fluid delivery chamber, each of said channels having substantially the same length and having an open inner end in fluid communication with said fluid delivery chamber for reception of fluid from said chamber and for delivery of said fluid, each of said channels having an open outer end for discharge of said fluid, the perimeters of said open inner end and said open outer end of each of said channels lying in respective planes substantially parallel to said axis of rotation, each of said channels having a corresponding longitudinal axis with an outer endpoint coincident with the open outer end of the corresponding channel, said outer endpoints of said longitudinal axes of said channels intersecting said exterior surface of said rotatable body at a plurality of preselected locations, each of said longitudinal axes of said channels having an inner endpoint coincident with the open inner end of the corresponding channel, said inner endpoints of said longitudinal axes of said channels being circumferentially spaced from each other and lying in a common plane perpendicular to said axis of rotation of said body, each of said channels being configured such that a straight line drawn between the inner endpoint and the outer endpoint of its longitudinal axis intersects said common plane of inner endpoints at a preselected one of a plurality of channel intersection angles, said intersection angles defining said preselected locations where said outer endpoints of said longitudinal axes of said channels intersect said exterior surface of said rotatable body, said intersection angles being pre-selected for application of at least one uniform band of said fluid having a predetermined width, at least one of said intersection angles being non-zero, at least two of said intersection angles being different from each other.

13. The rotating fluid applicator head of claim 12, wherein said fluid delivery chamber extends below said open inner ends of said channels and is formed with a ramp-like lower wall for smoothly directing said fluid into said channels upon rotation of said rotatable body.

14. The rotating fluid applicator head of claim 13 wherein said fluid delivery chamber has a lower feed well region of predetermined volume for receipt of a measured charge of said fluid and for discharge of said fluid.

15. The rotating fluid applicator head of claim 12, wherein said channels are sized and shaped to afford substantially similar resistance to flow of said fluid, said substantially similar resistance contributing to application of said uniform band of said fluid.

16. The rotating fluid applicator head of claim 15, wherein said substantially similar lengths of said channels are defined by a generally tapered contour of said exterior surface of said rotatable body including a plurality of steps sized and shaped to assist in self-cleaning of said applicator head.

17. The rotating fluid applicator head of claim 16, wherein successive values of said intersection angles are progressively increased, thereby defining a substantially helical pattern of said pre-selected locations where said outer endpoints of said longitudinal axes of said channels intersect said exterior surface of said rotatable body.

18. A rotating fluid wide band applicator head comprising:

a rotatable body having an axis of rotation;

a fluid delivery chamber disposed within said rotatable body; and a plurality of bounded channels defined in said body and emanating from said fluid delivery chamber, each of said channels having an open inner end in fluid communication with said fluid delivery chamber for reception of fluid from said chamber and for delivery of said fluid, each of said channels having an open outer end for discharge of said fluid, each of said channels having substantially the same length and defining a corresponding flow path of said fluid, each of said flow paths having an outer endpoint coincident with the open outer end of the corresponding channel, each of said flow paths having an inner endpoint coincident with the open inner end of the corresponding channel, said inner endpoints being circumferentially spaced from each other, said inner endpoints lying in a common plane perpendicular to said axis of rotation of said body, each one of said flow paths being configured such that fluid is discharged from its corresponding channel substantially parallel to said common plane of inner endpoints, said outer endpoints being axially spaced from each other, with respect to said axis of rotation of said body, at a plurality of predetermined locations selected for application of at least one band of said fluid having a predetermined width.

19. A method of applying a band of fluid to a workpiece having an internal cavity, comprising the steps of:

(a) providing a rotating fluid applicator head including:

a rotatable body having an axis of rotation, said rotatable body including a top portion and bottom portion and a perimetrical wall portion therebetween defining a fluid delivery chamber disposed within said rotatable body; and a plurality of bounded channels defined in said body extending through said perimetrical wall and emanating from said fluid delivery chamber, each of said channels having substantially the same length and having an open inner end in fluid communication with said fluid delivery chamber for reception of fluid from said chamber and for delivery of said fluid, each of said channels having an open outer end for discharge of said fluid, the perimeters of said open inner end and said open outer end of each of said channels lying in respective planes substantially parallel to said axis of rotation, each of said channels defining a corresponding flow path of said fluid, each of said flow paths having an inner endpoint coincident with the open inner end of the corresponding channel and an outer endpoint coincident with the open outer end of the corresponding channel, said inner endpoints lying in a common plane perpendicular to said axis of rotation of said body, said inner endpoints being circumferentially spaced from each other, at least one of said channels being configured such that a straight line drawn between the inner endpoint and outer endpoint of its flow path forms a non-zero angle with said common plane of inner endpoints, at least two of said channels being configured such that straight lines drawn between the inner endpoints and outer endpoints of their corresponding flow paths form different angles with said common plane of inner endpoints, said channels being sized, shaped and located for application of at least one band of said fluid having a predetermined width;

(b) inserting said rotating fluid applicator head into said internal cavity of said workpiece;

(c) supplying fluid to be applied to said fluid delivery chamber of said rotating fluid applicator head; and (d) rotating said rotating fluid applicator head at a predetermined angular velocity with said fluid subjected to pressure sufficient to apply said fluid.

20. A rotating fluid wide band applicator assembly comprising:

a rotating fluid wide band applicator head including:

a rotatable body having an axis of rotation said body including a sealed top portion and bottom portion and a perimetrical wall portion therebetween having an exterior surface;

a fluid delivery chamber disposed within said rotatable body and defined by said perimetrical wall portion;

a plurality of substantially straight, bounded channels defined in said body and emanating from said fluid delivery chamber, each of said channels having an open inner end in fluid communication with said fluid delivery chamber for reception of fluid from said chamber and for delivery of said fluid, each of said channels having an open outer end for discharge of said fluid, each of said channels having a corresponding longitudinal axis with an outer endpoint coincident with the open outer end of the corresponding channel, said outer endpoints of said longitudinal axes of said channels intersecting said exterior surface of said rotatable body at a plurality of preselected locations, each of said longitudinal axes of said channels having an inner endpoint coincident with the open inner end of the corresponding channel, said inner endpoints of said longitudinal axes of said channels being circumferentially spaced from each other and lying in a common plane perpendicular to said axis of rotation of said body, each of said channels being configured such that a straight line drawn between the inner endpoint and the outer endpoint of its longitudinal axis intersects said common plane of inner endpoints at a preselected one of a plurality of channel intersection angles, said intersection angles defining said pre-selected locations where said outer endpoints of said longitudinal axes of said channels intersect said exterior surface of said rotatable body, said intersection angles being preselected for application of at least one uniform band of said fluid having a predetermined width, at least one of said intersection angles being non-zero, at least two of said intersection angles being different from each other;

a spinner tube coupled to said rotating fluid wide band applicator head;

a rotary power device coupled to said spinner tube;

a feed tube disposed in fluid communication with said fluid delivery chamber of said rotating fluid wide band applicator head and further comprising a rotary shaft pressure seal for sealing between said rotating fluid wide band applicator head and said feed tube; and a supplemental flow inducing device disposed in fluid communication with said fluid delivery chamber of said rotating fluid wide band applicator head.

* * * * *